US008931580B2

(12) United States Patent
Cheng et al.

(10) Patent No.: US 8,931,580 B2
(45) Date of Patent: Jan. 13, 2015

(54) METHOD FOR USING DYNAMIC TARGET REGION FOR WELL PATH/DRILL CENTER OPTIMIZATION

(75) Inventors: Yao-Chou Cheng, Houston, TX (US); James E. Holl, Houston, TX (US); Joseph D. Dischinger, Kingwood, TX (US); Jose J. Sequeira, Jr., The Woodlands, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 253 days.

(21) Appl. No.: 13/509,524

(22) PCT Filed: Oct. 19, 2010

(86) PCT No.: PCT/US2010/053139

§ 371 (c)(1),
(2), (4) Date: May 11, 2012

(87) PCT Pub. No.: WO2011/096964

PCT Pub. Date: Aug. 11, 2011

(65) Prior Publication Data

US 2012/0285701 A1 Nov. 15, 2012

Related U.S. Application Data

(60) Provisional application No. 61/301,045, filed on Feb. 3, 2010.

(51) Int. Cl.
*E21B 43/30* (2006.01)
*E21B 47/02* (2006.01)

(52) U.S. Cl.
CPC ..... *E21B 43/30* (2013.01)
USPC ..... 175/45; 702/9; 702/11

(58) Field of Classification Search
USPC ..... 166/369, 254.1, 245; 175/45; 702/6, 9, 702/13, 14, 16; 703/5
See application file for complete search history.

(56) References Cited

U.S. PATENT DOCUMENTS 4,848,144 A * 7/1989 Ho ..... 73/152.49
5,220,963 A * 6/1993 Patton ..... 175/24

(Continued)

FOREIGN PATENT DOCUMENTS

CA 2312381 6/1999
EP 1036341 11/1998

(Continued)

OTHER PUBLICATIONS

McCann, P. et al. (2003), "Horizontal Well Path Planning and Correction Using Optimization Techniques", Journal of Energy Resources Technology, v. 123, pp. 187-193.

(Continued)

*Primary Examiner* — Daniel P Stephenson
(74) *Attorney, Agent, or Firm* — ExxonMobil Upstream Research Company Law Dept.

(57) ABSTRACT

Method for determining one or more optimal well trajectories and a drill center location for hydrocarbon production. A well path and drill center optimization problem (55) is solved in which one constraint is that a well trajectory must intersect a finite size target region (61) in each formation of interest, or in different parts of the same formation. The finite target size provides flexibility for the optimization problem to arrive at a more advantageous solution. Typical well path optimization constraints are also applied, such as anti-collision constraints and surface site constraints (62).

11 Claims, 4 Drawing Sheets

(56) References Cited

U.S. PATENT DOCUMENTS 5,468,088 A 11/1995 Shoemaker et al.
5,671,136 A 9/1997 Willhoit
5,708,764 A 1/1998 Borrel et al.
5,992,519 A 11/1999 Ramakrishman et al.
6,035,255 A 3/2000 Murphy et al.
6,044,328 A 3/2000 Murphy et al.
6,070,125 A 5/2000 Murphy et al.
6,191,787 B1 2/2001 Lu et al.
6,219,061 B1 4/2001 Lauer et al.
6,236,994 B1 5/2001 Swartz et al.
6,353,677 B1 3/2002 Pfister et al.
6,388,947 B1 5/2002 Washbourne et al.
6,516,274 B2 2/2003 Cheng et al.
6,519,568 B1 2/2003 Harvey et al.
6,549,854 B1 4/2003 Malinverno et al.
6,549,879 B1 4/2003 Cullick et al.
6,643,656 B2 11/2003 Peterson
6,697,063 B1 2/2004 Zhu
6,757,613 B2 6/2004 Chapman et al.
6,766,254 B1 7/2004 Bradford et al.
6,772,066 B2 8/2004 Cook
6,823,266 B2 11/2004 Czernuszenko et al.
6,826,483 B1 11/2004 Anderson et al.
6,834,732 B2 12/2004 Haarstad
6,912,467 B2 6/2005 Schuette
6,912,468 B2 6/2005 Marin et al.
6,968,909 B2 11/2005 Aldred et al.
6,980,939 B2 12/2005 Dhir et al.
6,980,940 B1 12/2005 Gurpinar et al.
6,993,434 B2 1/2006 Cheng et al.
7,027,925 B2 4/2006 Terentyev et al.
7,031,842 B1 4/2006 Musat et al.
7,050,953 B2 5/2006 Chiang et al.
7,054,752 B2 5/2006 Zabalza-Mezghani et al.
7,079,953 B2 7/2006 Thorne et al.
7,136,064 B2 11/2006 Zuiderveld
7,181,380 B2 2/2007 Dusterhoft et al.
7,203,342 B2 4/2007 Pedersen
7,204,323 B2 * 4/2007 Kingsley ..... 175/46
7,248,256 B2 7/2007 Minami et al.
7,248,258 B2 7/2007 Acosta et al.
7,272,973 B2 9/2007 Craig
7,281,213 B2 10/2007 Callegari
7,283,941 B2 10/2007 Horowitz et al.
7,314,588 B2 1/2008 Blankenship
7,330,791 B2 2/2008 Kim et al.
7,337,067 B2 2/2008 Sanstrom
7,359,845 B2 4/2008 Kelfoun
7,362,329 B2 4/2008 Zuiderveld
7,366,616 B2 4/2008 Bennett et al.
7,373,251 B2 5/2008 Hamman et al.
7,437,358 B2 10/2008 Arrouye et al.
7,460,957 B2 12/2008 Prange et al.
7,478,024 B2 1/2009 Gurpinar et al.
7,512,543 B2 3/2009 Raghuraman et al.
7,539,625 B2 5/2009 Klumpen et al.
7,546,884 B2 6/2009 Veeningen et al.
7,548,873 B2 6/2009 Veeningen et al.
7,565,243 B2 7/2009 Kim et al.
7,576,740 B2 8/2009 Dicken
7,584,086 B2 9/2009 Frankel
7,596,481 B2 9/2009 Zamora et al.
7,603,264 B2 10/2009 Zamora et al.
7,603,265 B2 10/2009 Mainguy et al.
7,606,666 B2 10/2009 Repin et al.
7,616,213 B2 11/2009 Chuter
7,627,430 B2 12/2009 Hawtin
7,630,872 B2 12/2009 Xia et al.
7,630,914 B2 12/2009 Veeningen et al.
7,657,407 B2 2/2010 Logan
7,657,414 B2 2/2010 Zamora et al.
7,668,700 B2 2/2010 Erignac et al.
7,684,929 B2 3/2010 Prange et al.
7,725,302 B2 5/2010 Ayan et al.
7,739,089 B2 6/2010 Gurpinar et al.
7,739,623 B2 6/2010 Liang et al.
7,743,006 B2 6/2010 Woronow et al.
7,778,811 B2 8/2010 Kelfoun
7,796,468 B2 9/2010 Kellogg
7,814,989 B2 10/2010 Nikolakis-Mouchas et al.
7,876,705 B2 1/2011 Gurpinar et al.
7,878,268 B2 2/2011 Chapman et al.
7,913,190 B2 3/2011 Grimaud et al.
7,925,483 B2 4/2011 Xia et al.
7,953,585 B2 5/2011 Gurpinar et al.
7,953,587 B2 5/2011 Bratton et al.
7,970,545 B2 6/2011 Sanstrom
7,986,319 B2 7/2011 Dommisse et al.
7,991,600 B2 8/2011 Callegari
7,995,057 B2 8/2011 Chuter
8,005,658 B2 8/2011 Tilke et al.
8,055,026 B2 11/2011 Pedersen
8,094,515 B2 1/2012 Miller et al.
8,103,493 B2 1/2012 Sagert et al.
8,155,942 B2 4/2012 Sarma et al.
8,199,166 B2 6/2012 Repin et al.
8,301,426 B2 10/2012 Abasov et al.
8,325,179 B2 12/2012 Murry et al.
8,346,695 B2 1/2013 Pepper et al.
8,364,404 B2 1/2013 Legendre et al.
8,381,815 B2 2/2013 Karanikas et al.
8,727,017 B2 5/2014 Hilliard et al.
8,731,873 B2 * 5/2014 Walker et al. ..... 703/1
8,731,887 B2 * 5/2014 Hilliard et al. ..... 703/9
8,812,334 B2 8/2014 Givens et al.
2002/0177955 A1 11/2002 Jalali et al.
2003/0226661 A1 * 12/2003 Lima et al. ..... 166/245
2004/0012670 A1 1/2004 Zhang
2004/0207652 A1 10/2004 Ratti et al.
2004/0210395 A1 10/2004 Cheng et al.
2004/0220790 A1 * 11/2004 Cullick et al. ..... 703/10
2005/0119959 A1 6/2005 Eder
2005/0171700 A1 8/2005 Dean
2006/0151214 A1 7/2006 Prange et al.
2006/0224423 A1 10/2006 Sun et al.
2006/0247903 A1 11/2006 Schottle et al.
2006/0265508 A1 11/2006 Angel et al.
2007/0199721 A1 8/2007 Givens et al.
2007/0266082 A1 11/2007 McConnell et al.
2008/0088621 A1 4/2008 Grimaud et al.
2008/0109490 A1 5/2008 Arnegaard et al.
2008/0165185 A1 7/2008 Smith et al.
2008/0165186 A1 7/2008 Lin
2008/0243749 A1 10/2008 Pepper et al.
2008/0275648 A1 * 11/2008 Illfelder ..... 702/7
2008/0294393 A1 11/2008 Laake et al.
2008/0306803 A1 12/2008 Vaal et al.
2009/0027380 A1 1/2009 Rajan et al.
2009/0027385 A1 1/2009 Smith
2009/0037114 A1 2/2009 Peng et al.
2009/0040224 A1 2/2009 Igarashi et al.
2009/0043507 A1 2/2009 Dommisse et al.
2009/0056935 A1 3/2009 Prange et al.
2009/0089028 A1 4/2009 Sagert et al.
2009/0125362 A1 5/2009 Reid et al.
2009/0157367 A1 6/2009 Meyer et al.
2009/0182541 A1 7/2009 Crick et al.
2009/0198447 A1 8/2009 Legendre et al.
2009/0200014 A1 8/2009 Schottle et al.
2009/0205819 A1 8/2009 Dale et al.
2009/0216505 A1 8/2009 Sarma et al.
2009/0222742 A1 9/2009 Pelton et al.
2009/0229819 A1 9/2009 Repin et al.
2009/0240564 A1 9/2009 Boerries et al.
2009/0295792 A1 12/2009 Liu et al.
2009/0299709 A1 12/2009 Liu
2009/0303233 A1 12/2009 Lin et al.
2010/0125349 A1 5/2010 Abasov et al.
2010/0169018 A1 7/2010 Brooks
2010/0171740 A1 7/2010 Andersen et al.
2010/0172209 A1 7/2010 Miller et al.
2010/0179797 A1 7/2010 Cullick et al.
2010/0185395 A1 7/2010 Pirovolou et al.
2010/0191516 A1 7/2010 Benish et al.

(56) References Cited

U.S. PATENT DOCUMENTS

| | | | | |
|---|---|---|---|---|
| 2010/0206559 | A1 | 8/2010 | Sequeira, Jr. et al. | |
| 2010/0214870 | A1 | 8/2010 | Pepper et al. | |
| 2010/0225642 | A1 | 9/2010 | Murray et al. | |
| 2010/0271232 | A1 | 10/2010 | Clark et al. | |
| 2010/0283788 | A1 | 11/2010 | Rothnemer et al. | |
| 2010/0286917 | A1 | 11/2010 | Hazlett et al. | |
| 2010/0307742 | A1 | 12/2010 | Phillips et al. | |
| 2011/0029293 | A1 | 2/2011 | Petty et al. | |
| 2011/0044532 | A1 | 2/2011 | Holl et al. | |
| 2011/0054857 | A1 | 3/2011 | Moguchaya | |
| 2011/0060572 | A1 | 3/2011 | Brown et al. | |
| 2011/0074766 | A1 | 3/2011 | Page et al. | |
| 2011/0106514 | A1 | 5/2011 | Omeragic et al. | |
| 2011/0107246 | A1 | 5/2011 | Vik | |
| 2011/0115787 | A1 | 5/2011 | Kadlee | |
| 2011/0153300 | A1 | 6/2011 | Holl et al. | |
| 2011/0157235 | A1 | 6/2011 | FitzSimmons | |
| 2011/0161133 | A1 | 6/2011 | Staveley et al. | |
| 2011/0172976 | A1 | 7/2011 | Budiman et al. | |
| 2011/0175899 | A1 | 7/2011 | Bittar et al. | |
| 2012/0150449 | A1 | 6/2012 | Dobin | |
| 2012/0166166 | A1 | 6/2012 | Czernuszenko | |
| 2012/0285701 | A1* | 11/2012 | Cheng et al. | 166/369 |

FOREIGN PATENT DOCUMENTS

| | | |
|---|---|---|
| EP | 1230566 | 11/2000 |
| WO | 00/14574 | 3/2000 |
| WO | WO03/072907 | 9/2003 |
| WO | WO03/078794 | 9/2003 |
| WO | 03/003053 | 10/2003 |
| WO | 2005/020044 | 3/2005 |
| WO | 2006/029121 | 3/2006 |
| WO | WO2007/076044 | 7/2007 |
| WO | WO2007/100703 | 9/2007 |
| WO | 2008/121950 | 10/2008 |
| WO | 2009/039422 | 3/2009 |
| WO | WO2009/032416 | 3/2009 |
| WO | 2009/075946 | 6/2009 |
| WO | 2009/079160 | 6/2009 |
| WO | WO2009/080711 | 7/2009 |
| WO | 2009/148681 | 12/2009 |
| WO | WO2010/141038 | 12/2010 |
| WO | 2011/031369 | 3/2011 |
| WO | 2011/038221 | 3/2011 |

OTHER PUBLICATIONS

Mugerin, C. et al. (2002), "Well Design Optimization: Implementation in GOCAD", 22$^{nd}$ Gocad Meeting, Jun. 2002.

Rainaud, J.F. et al. (2004), "WOG—Well Optimization by Geosteering: A Pilot Software for Cooperative Modeling on Internet", Oil & Gas Science and Technology—Rev. JFP, v. 59, No. 4, pp. 427-445.

Reed, P. et al. (2003), "Simplifying Multiobjective Optimization Using Genetic Algorithms", Proceedings of World Water and Environmental Resources Congress.

Udoh, E. et al. (2003). "Applications of Strategic Optimization Techniques to Development and Management of Oil and Gas Resources", 27$^{th}$ SPE Meeting, Aug. 2003.

Bharat, K, et al. (2001), "Who Links to Whom: Mining Linkage Between Web sites", *Proceedings of the 2001 IEE Int'l Conf. on Data Mining*, pp. 51-58.

Cabral, B., et al (1995), "Accelerated Volume Rendering and Tomographic Reconstruction Using Texture Mapping Hardware", *IEEE in Symposium on Volume Visualization*, pp. 91-98, 131.

Crawfis, R., et al. (1992), "Direct Volume Visualization of Three-Dimensional Vector Fields", *Proceedings of the 1992 Workshop on Volume Visualization*, pp. 55-60.

Drebin, R., et al. (1988), "Volume Rendering", *Computer Graphics, the Proceedings of 1988 SIGGRAPH Conference*, vol. 22, No. 4, pp. 65-74.

Lorensen, W., et al., (1987), "Marching Cubes: A High-Resolution 3D Surface Construction Algorithm", *Computer Graphics, The Proceeding of 1987 SIGGRAPH Conference*, vol. 21, No. 4, pp. 163-169.

* cited by examiner

METHOD FOR USING DYNAMIC TARGET REGION FOR WELL PATH/DRILL CENTER OPTIMIZATION

CROSS-REFERENCE TO RELATED APPLICATION

This application is the National Stage entry under 35 U.S.C. 371 of PCT/US2010/053139 that published as WO 2011/096964 and was filed on 19 Oct. 2010 which claims the benefit of U.S. Provisional Application No. 61/301,045, filed on 3 Feb. 2010, each of which is incorporated by reference, in its entirety, for all purposes.

FIELD OF THE INVENTION

The invention relates generally to the field of hydrocarbon production, and more particularly to conducting drilling planning for determining the configuration of drill centers and/or sub-sea templates within a three dimensional earth model.

BACKGROUND OF THE INVENTION

While the task of drilling planning and well path/well trajectory identifications is primarily an engineering function, a critical objective of drilling planning is to maximize the output of the oil/gas extraction from given reservoirs. Understanding of the reservoir properties as well as geological constraints, such as potential hazard avoidance, is vital to the success of a drilling program.

In a currently typical work flow of a drilling planning session, for each planned well, a potential drill center location (on the surface) and a set of one or more (subsurface) target locations are selected based on the reservoir properties. Geoscientists and engineers can reposition the targets and/or relocate the drill center location to obtain a satisfactory well trajectory while meet most of, if not all, the engineering and geological constraints in an interactive planning session. In this current practice, the targeted locations represented by points in 3D space would have been pre-determined based on the geological/reservoir models for reservoir productivity by geologists and reservoir engineers. Often, an optimization algorithm is then used to find the optimal drill center location for those pre-determined target locations based on engineering and drilling constraints. How this drilling planning is currently done is discussed further in the following paragraphs.

The oil field planning involves optimization of a wide variety of parameters including drill center location(s), drill center/slot design, reservoir target location(s), well trajectory and potential hazard avoidance while maximizing stability and cost-effectiveness given the stratigraphic properties with wide variety (often conflicted) constraints. Current field/drill center design practices are often sequential and can be inefficient, for example:

1. Geoscientist selects potential targets based on geologic interpretation and understanding of reservoir properties.
2. Multiple well trajectories are designed and given to the drilling engineer for more detailed well design and analysis.
3. The drill center locations are selected or modified based on the results of the well design and analysis step.
4. Changes to the target location(s), number of targets, or basic trajectory parameters are made during the iterative steps by geologists and drilling engineers; depending on the complexity of the well path and geology, the final drill center locations and well trajectory may take many such iterations and several weeks/months of calendar time.

Several factors affect the selection of well drill center locations and their configuration since it is an integral part of an optimal capital investment plan including fields, reservoirs, drilling centers, wells, etc. See, for example, Udoh et al., "Applications of Strategic Optimization Techniques to Development and Management of Oil and Gas Resources," $27^{th}$ SPE meeting, (2003). Optimization technology in the current state of the art places primary focus on how to determine and optimize each component. For example, U.S. Pat. No. 6,549,879 to Cullick et al. discloses a two-stage method for determining well locations in a 3D reservoir model. Well location and path is determined while satisfying various constraints including: minimum inter-well spacing, maximum well length, angular limits for deviated completions and minimum distance from reservoir and fluid boundaries. In their paper titled "Horizontal Well Path Planning and Correction Using Optimization Techniques" (*J. of Energy Resources Technology* 123, 187-193 (2003)), McCann et al. present a procedure that uses nonlinear optimization theory to plan 3D well paths and path correction while drilling. This process focuses primarily on engineering criteria for well trajectory such as minimum length, torque and drag as well as some other user imposed constraints. In another paper, "Well Design Optimization: Implementation in GOCAD" ($22^{nd}$ Gocad Meeting, June, 2002), Mugerin et al. present an integrated well planning that includes geological and engineering constraints for target selection and path generation. U.S. Pat. No. 7,460,957 to Prange et al. presents a method that automatically designs a multi-well development plan given a set of previously interpreted subsurface targets.

From the above-described practices and arts, one can see well path planning often involves geological and/or engineering constraints to derive a set of optimal well paths. Significant challenges remain such as integrating optimal well path constraints with finding optimal drill center locations, since the conflicting objectives of well targets, well paths and/or drill center locations may complicate the optimization process which would lead to sub-optimal solutions. Furthermore, as stated by Prange et al., the proposed multi-well trajectories optimization that relies on a set of pre-selected fixed targets could further limit the selection of optimal drill center configuration since the constraints on the drillable well trajectories to multiple fixed targets would add extra complexity to the overall optimization processes and may not lead to an optimum solution.

SUMMARY OF THE INVENTION

In one embodiment, the invention is a method for determining drill center location and drill path for a well into a hydrocarbon formation, comprising selecting a target region of finite extent within the formation; and solving an optimization problem wherein a drill center location and a drill path are determined subject to a plurality of constraints, one of said constraints being that the drill path must penetrate the target region.

Persons skilled in well path optimization will appreciate that at least some of the present inventive method will preferably be performed with the aid of a programmed computer.

BRIEF DESCRIPTION OF THE DRAWINGS

The present invention will be better understood by referring to the following detailed description and the attached drawings in which.

The invention will be described in connection with example embodiments. To the extent that the following description is specific to a particular embodiment or a particular use of the invention, this is intended to be illustrative only, and is not to be construed as limiting the scope of the invention. On the contrary, it is intended to cover all alternatives, modifications and equivalents that may be included within the scope of the invention, as defined by the appended claims.

DETAILED DESCRIPTION OF EXAMPLE EMBODIMENTS

The present invention is a method for facilitating the well planning and screening process by creating more flexible regions of target definition and/or a bottom-up approach focus on productivity of well segments within the reservoirs. The inventive method can also be used in an interactive environment in which the user can rapidly evaluate alternative drill center locations and well trajectories on the basis of geological as well as engineering constraints.

The focus of the inventive method is on utilizing flexible regions of interests in the reservoirs for the purpose of satisfying multi-well constraints to derive optimal drill center configuration. The inventive method also provides rapid, multi-disciplinary evaluation of many alternative scenarios. The inventive method enables greater value capture by bringing the decision making and technical analysis together for rapid execution and scenario analysis.

The present inventive method allows the user to obtain optimal drilling configurations in which constraints such as boundaries or regions of targeted locations in the reservoirs, maximum well spacing, maximum dogleg severities of well trajectories, can be set while minimizing total cost and/or maximizing reservoir productivity.

Figure 5:
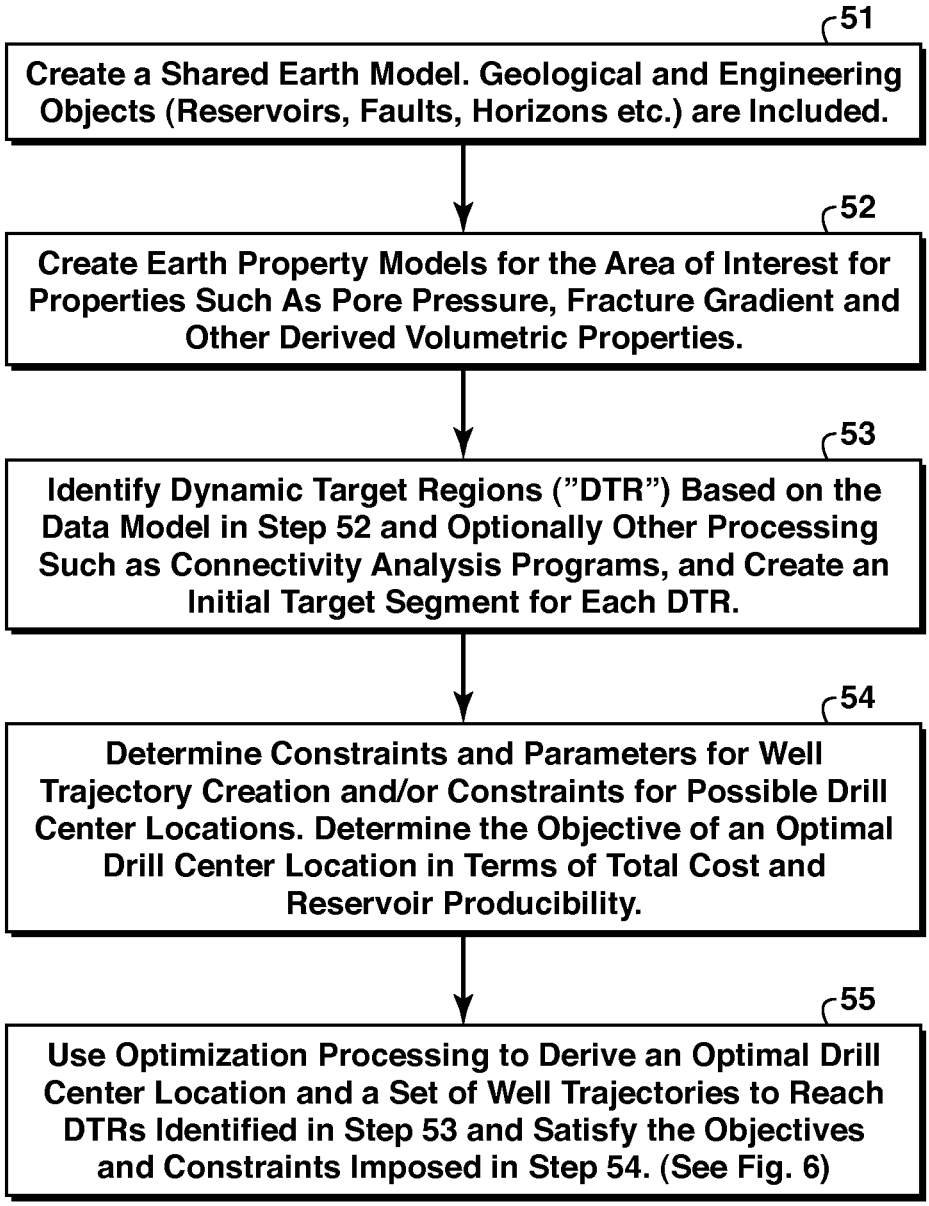
FIG. 5 is a flow chart showing basic steps in one embodiment of the present inventive method.

Basic steps in one embodiment of the invention are shown in the flow chart of FIG. 5. In step 51, a shared earth model is created that includes geological interpretation (e.g. horizons and faults), seismic data, and well data. Preferably, the earth model is a three-dimensional representation of one or more potential reservoirs; geological and engineering objects such as fault surfaces and salt bodies can also be defined in the model for object avoidance.

In step 52, an earth property model is created that extends from the seafloor (or land surface) to below possible well total depth locations (sufficiently below the target reservoir interval(s) to accommodate "rat hole"). Properties within the model may include, for example, pore pressure, fracture gradient, temperature, lithology (sand/shale), and stress orientation and magnitude. These properties may be calculated or derived using any of several methods, including, but not limited to, (1) predictive equations based on measured or inferred gradients, offset well information, and lithology estimates; (2) derived from 3D seismic data or other volumetric properties (e.g. impedance); or (3) interpolated from offset wells. Properties may be pre-calculated and stored in a 3D data volume and/or in some cases calculated as needed "on the fly." Properties for the model may be generated using, for example, existing computer processes or programs such as geological model analysis or reservoir simulators for property modeling and engineering programs such as the commercially available product GOCAD for well path calculation.

In step 53, dynamic target regions ("DTRs") are identified. Dynamic target regions are areas (or volumes in a 3D model) defined within the shared earth model based on geoscience and/or reservoir engineering criteria (e.g. reservoir sweet spots, or well locations optimized through reservoir simulation). Other factors, such as drainage boundaries, may be relevant for determining the extent of a DTR. Alternatively, a DTR may be defined based on a set of 3D geo-bodies based on seismic data using connectivity analysis such as is described in U.S. Pat. No. 6,823,266 to Czernuszenko et al. Among other alternatives, DTR could be defined as a set of bounding polygons in stratigraphic surfaces of reservoirs. Instead of a point location as in the traditional practice and methods, the present inventive method uses finite-sized DTRs and allows many possible path segments to be selected and constrained by them. The shape and size of a DTR can be defined by geoscientists to cover the area of interest that the well trajectory should pass through. For example, the area of a DTR for a producing well would be to cover the high permeability rock in the reservoir which would yield more oil/gas extraction. Other tools such as connectivity analysis program mentioned earlier can also be used to help determining the size and shape of DTR. In a highly connected reservoir, a DTR could be as big as a detected geo-body based on a low threshold connectivity criteria since the extraction of oil/gas from the planned well path would depend less on the location within the geo-body. On the other hand, in a highly fragmented reservoir, the well path needs to penetrate a narrowly defined area. Other factors, such as uncertainty of the interpreted reservoir geometry or uncertainty of the reservoir properties can also affect the size and shape of the DTR. The DTR is preferably defined to be as large as possible without compromising the criteria used to define eligibility.

As with the point targets in traditional practice, each DTR requires that a well path passes through it. In some embodiments of the invention, the initial focus is on determining a path segment (called target segment) within each DTR before determining the entire well trajectory from a surface location to the DTR. (Terms such as well trajectory and well path or drill path are used essentially interchangeably herein.) A target segment is a desired pathway within a DTR based on its potential to be a partial segment of a well trajectory. The determination of the location and geometry (or shape) of a target segment would focus on the effect on production performance in terms of geological setting including factors such as lithology and connectivity. That is, a desired target segment within the DTR could be determined first based mainly on the rock properties and with less concern about the cost of building such a well path segment. The initial target segment can then be modified if necessary to another position or geometrical shape in order to accommodate, for example, other well trajectories for a given drill center location. The finite size of the DTR gives the user flexibility to select an initial target segment that will likely speed convergence of the well path optimization program.

In step 54, constraints are defined on well paths, inter-well distances, and/or drill center. Well path constraints may be based anti-collision criteria on given geological objects such as faults, to avoid being too close to fault surfaces. Another anti-collision constraint is to disallow any two well trajectories that come closer to each other than some pre-selected minimum distance. Constraint conditions such as reservoir quality (porosity), minimum total measured depth, accumulated dogleg angle, distances for anti-collision and/or potential area for the drill center location can be predefined or chosen by the user. The constraints are determined just as in traditional well path optimization, and therefore the person skilled in the technical field will understand how to perform step 54.

Basic trajectory parameters (e.g. dog-leg severity, kick-off depth, hold distances and trajectory type) are selected by the geoscientist and/or drilling engineer, and a well path connecting the one or more selected DTRs via target segments may be created. The geometry and location of the target segments within the DTRs are modified if necessary; see step 63 in FIG. 6. The modification of the target segments in some cases could yield a lesser producible well path within each DTR, but the flexibility of allowing such modifications can yield a better overall cost of, and benefits from, the selected drill center location and its associated well path or paths.

Optionally, the user could also impose inter-well constraints such as well-to-well distance functions along the potential well trajectories. Optionally, the user could also impose drill center constraints, i.e. parts of the surface area to be avoided as unsuitable for the drill center.

In step 55 of FIG. 5, optimization processing is used to derive an optimal drill center location and a set of well trajectories to reach the DTRs identified in step 53 and satisfy the objectives and constraints imposed on step 54. Detail of this step for one embodiment of the invention is outlined in the flow chart of FIG. 6. What is outlined in FIG. 6 is currently standard drill path and drill center optimization procedure in well drilling design except that the traditional constraint that the drill path must pass through a point is replaced by relaxing the point constraint to anywhere in a finite (non-infinitesimal) region.

Figure 1:
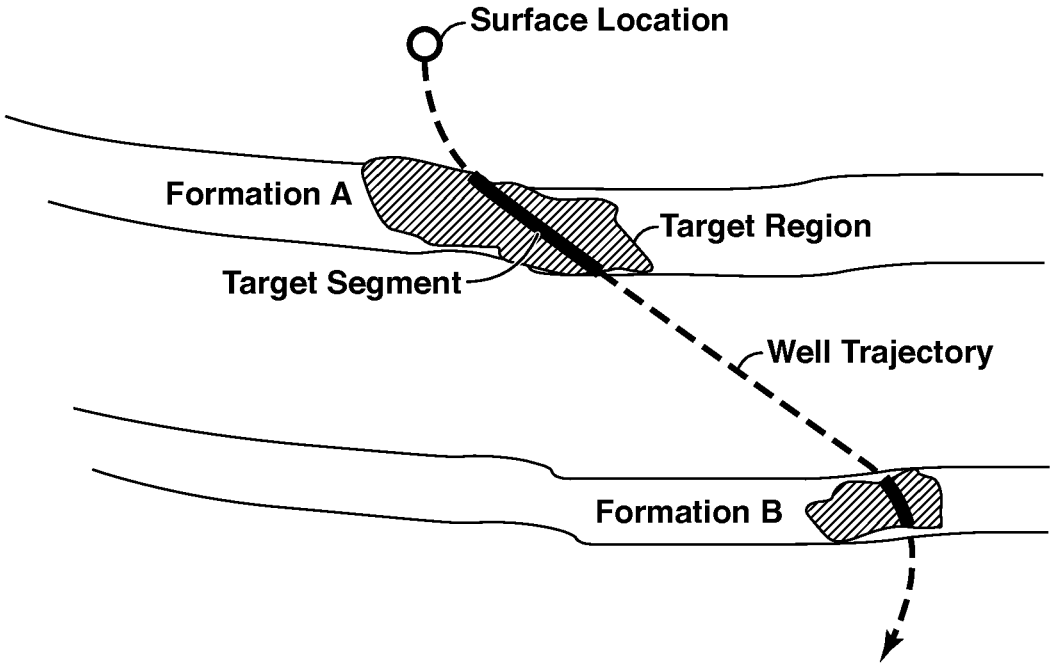
FIG. 1 shows an example of targeted areas in a reservoir in the present inventive method.
Figure 2:
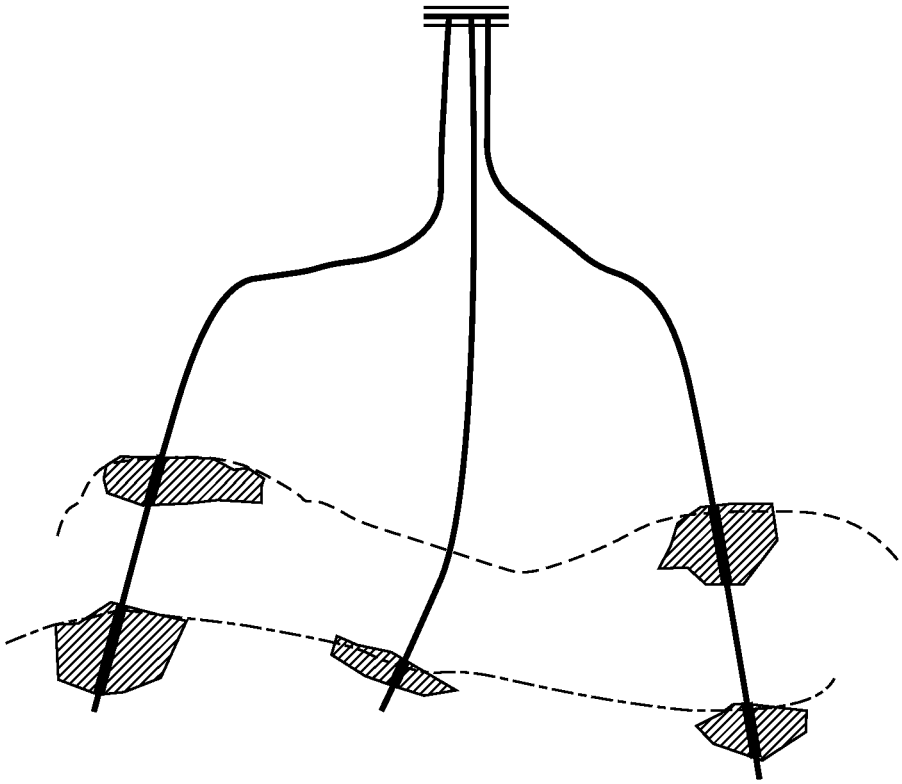
FIG. 2 shows a drill center with three well trajectories passing through a total of five Dynamic Target Regions.
Figure 3:
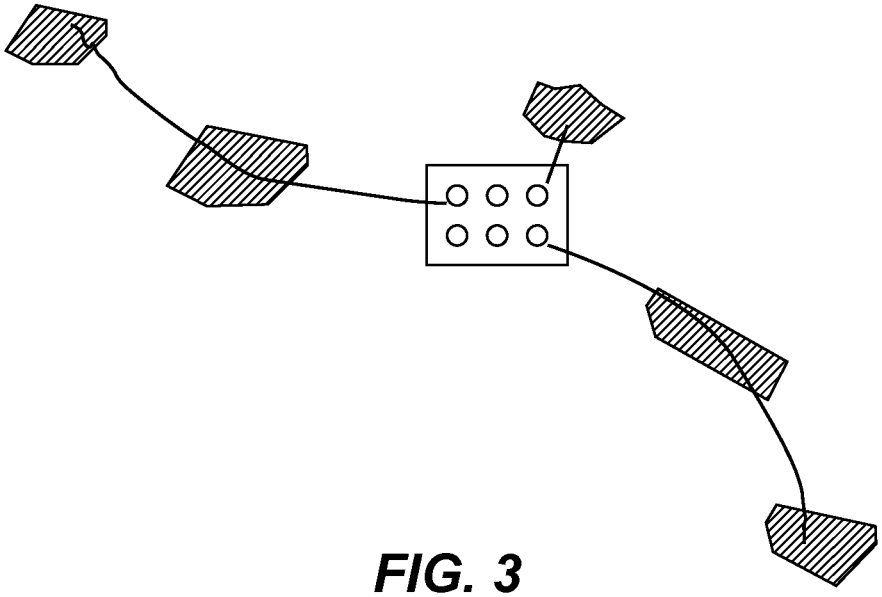
FIG. 3 shows a top view of the drill center and three wells of FIG. 2.
Figure 6:
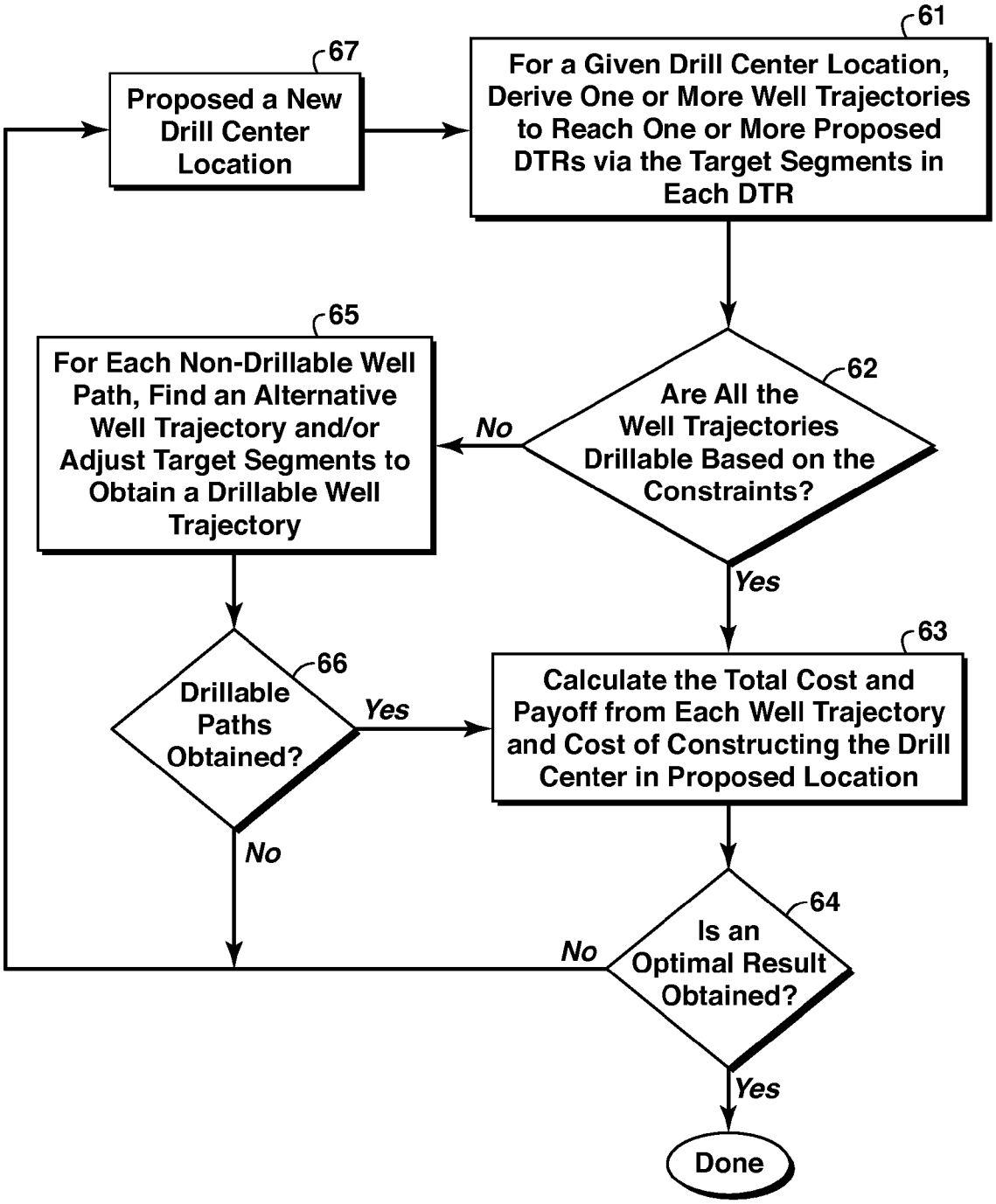
FIG. 6 is a flow chart showing basic steps in a well trajectory optimization process that may be used in the last step of FIG. 6.

FIG. 6 describes an embodiment of the invention in which the user selects an initial target segment through each DTR before the optimization process begins. Thus, at step 61, an initial well trajectory segment, sometimes referred to herein as a target segment, is determined within each DTR. The selected target segments are used as initial choices that may be varied in the optimization process. Also at step 61, an initial drill center location that satisfies any surface area constraints is identified. The design of the drill center includes enough slots to accommodate the number of well trajectories that may be created. Also at step 61, one or more (depending on the number of DTRs) well trajectories are created using, for example, one of several existing well path creation algorithms such as GOCAD, starting from a slot or slots in the drill center. The generated slot configurations also allow the optimization process to apply on each well trajectory, so the optimal slot allocation can also be determined; such a result is shown on FIG. 3, which shows a drill center with six slots, three of which are used to reach five DTRs. The well creation algorithms will yield a drillable well path based on the selected engineering constraints such as maximum dogleg severities. Each well trajectory is defined so as to reach one or more DTRs by connecting the initially selected target segments.

As the well path is being created, earth property information may be automatically extracted or calculated along the well path from the earth model. These properties may be displayed along the well bore in numerous ways including: by coloring the well path object, pseudo-log type displays, or 2-D plots linked to the well path (e.g. pore pressure, fracture gradient profiles).

In this mode, the extracted properties can be used to quickly screen or evaluate (step 62) a possible well path scenario. The cost of drilling such a well path can also be estimated since the total measured depth and the curvature of the path are known. Using this approach, well path and design scenarios can be rapidly generated and screened efficiently.

If one of the well trajectories cannot be generated or the generated trajectory does not meet the imposed constraints (for example, non-drillable well path, too close to a salt dome), the corresponding trajectory segment(s) can be adjusted within the corresponding one or more DTRs or another optimization variable can be adjusted (step 65). The evaluation of step 62 is then repeated at step 66. This process may be implemented as a sub-task of optimization of a single well path based on the given surface location and sequence of DTRs. The sub-task would allow an alternate optimal well trajectory be generated to meet the imposed constraints.

Available well-path generation products follow certain predefined methods (such as Continue Curve To the Target, Hold Some Length and Correct To the Target in a Specified Direction, etc.) in order to maintain smooth transition while drilling. Typically, each path consists of a sequence of straight and curved segments. The straight segments cost less to drill and the curved sections are necessary for the transition from one azimuth direction to another in order to reach deviated locations. Most of the existing path generation programs are deterministic based on a set of constrains given by engineers, but optimization algorithms may also be used to derive better solutions. Any well path generation method is within the scope of the present invention as long as it allows for a finite-size target region.

At step 63, the optimization process then evaluates a total "goodness" measure, typically called an objective function or cost function, for the current combination of drill center location, slot allocation and well path(s). The objective function is a mathematically defined quantity that can be calculated for each proposed drill path and that is constructed to be a quantitative measure of the goodness of the trajectory.

An objective function is a function of certain selected measurements. One such measurement is the total measured depth of all the well trajectories. This measurement is obviously related to the cost of constructing the proposed wells (the longer the path, the higher the cost). Other measurements such as total dogleg angles and Drill Difficulty Index would also relate to the cost (it costs more to drill a highly curved well trajectory). Other measurements may relate to the rewards, i.e. economic payoff, of a successful drilling operation. One way to measure that is to calculate how much of a well trajectory penetrates to the high porosity areas and/or highly connected reservoir regions. Step 63 is the same as in traditional well path optimization methods.

At step 64, the computed measure of goodness is compared to a user-set criterion. Thus, the value of the objective function for the current combination of drill center location and drill path(s) is compared to a desired value. If the criterion is satisfied, the process of FIG. 6 is finished. If it is not satisfied, and no other stopping condition applies, then as in traditional methods the process is repeated with the previous drill center location adjusted at step 67. ((Step 67 may also be reached if an evaluation at step 66 is negative.) This cycle repeats until the process is stopped at step 64, and in this way an optimal drill center location is obtained or a suboptimal location that satisfies user-defined objectives is reached. The method of selecting a new drill center location for each iteration may be highly dependent on the mathematical functions of the optimization algorithms. For example, a stochastic method, similar to the one described in the paper "Simplifying Multi-objective Optimization Using Genetic Algorithms," by Reed et al., in Proceedings of World Water and Environmental Resources Congress (2003) would randomly select a new location based on the past iterations by permutation of certain parameters. Other deterministic algorithms would try a new location based on the calculated converging path. All such methods are within the scope of the present invention.

A goal of the present inventive method is to minimize the total cost of building and operating drill centers and associated wells and to maximize the benefits and rewards of such a drill configuration. The above-described optimization step 55 is an example of "Multi-Objective Optimization," a known method (except for the role of the DTRs) employed in some embodiments of the present invention. In general, this method involves optimizing two or more conflicting objectives subject to given constraints.

EXAMPLE APPLICATIONS OF THE PRESENT INVENTIVE METHOD

The following are examples of how the invention may be implemented.

Example 1

Drill center planning and well path optimization based on user defined polygonal area in the reservoir.

Data input: A set of six polygonal areas R(i), identified as Dynamic Target Regions from reservoir properties such as amplitude mapping on the top surface of the reservoirs. For each R(i), a well trajectory is expected to be derived based on user preference parameters such as build length and dog-leg angle criteria. This example needs only a simple cost function based on the total measured length of the entire well with fixed dollars per feet. The drill center is designed with 6 slots and each slot would host the start of a well trajectory to reach one of the proposed DTRs. The location of the drill center is constrained to a specified rectangular surface area (41 in FIG. 4A).

Objective function: Find an optimal drill center location with optimal defined by the following:

Minimize total cost of drilling well trajectories~ΣMD(i) for i=1 to N, where N=6 is the number of well trajectories; and MD(i) is total measured depth of i-th well trajectory; subject to:

1) each well trajectory passes through somewhere in the interior of a corresponding Dynamic Target Region; and 2) each well trajectory satisfies user preference parameters within some specified tolerance.

Figures 4A, 4B:
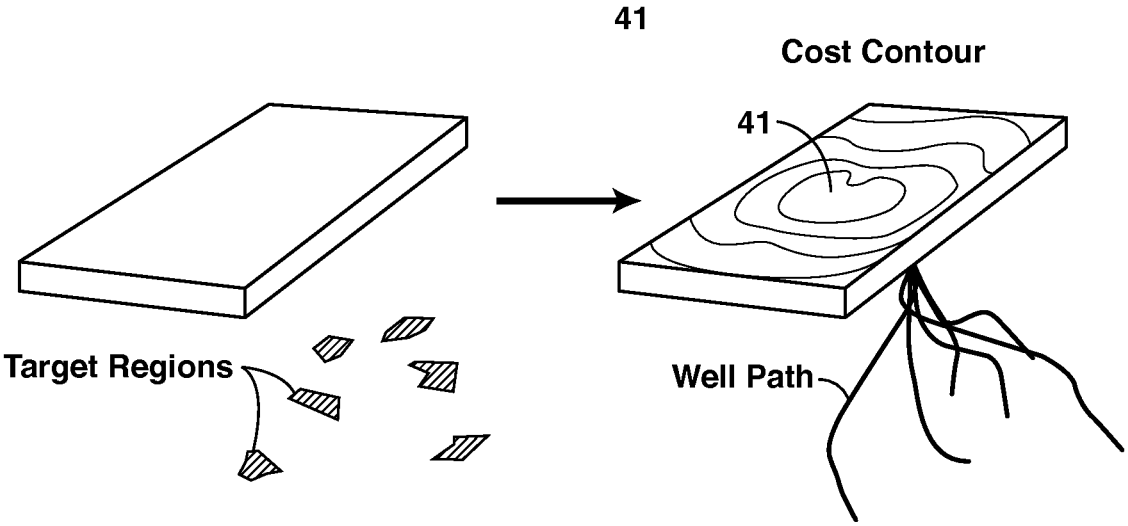
FIGS. 4A-B show drill center cost contours, several dynamic target regions identified, and well trajectories and drill center resulting from optimization by the present inventive method.

FIGS. 4A-B show the results of optimization by the present inventive method, with DTRs shown in FIG. 4A, and cost contours shown in FIG. 4B on the surface area 41 designated for possible drill center location.

Example 2

Drill center planning and well path optimization using engineering/reservoir properties as proxy.

Data input: A set of volumetric defined regions VR(i), identified as Dynamic Target Regions from the reservoir properties such as amplitude attributes on a 3D seismic data volume. For each VR(i), a well trajectory is derived based on the user preference parameters described in Example 1. Additionally, a set of geological constraints such as distance to fault surfaces, salt domes are imposed. The conditions of anti-collision to the geological objects can be determined by the geometric distance calculations and/or by calculated proxy volumes encompassing the 3D earth model where each voxel contains information on the relationship to the closest geological objects. To maximize the total "reward" of well trajectories with Target Segments penetrating the VR(i), the reward value can be determined by the total accumulated value within the defined region and/or by other performance measurements. The cost of drilling is also represented by 3D volumetric data. In this data volume, cost values are imbedded in each voxel representing the cost of well segments passing through the cell location. The cost estimations for each cell may be derived from parameters such as drilling difficulty index, rock type in the cell location, as well as geological and geophysical properties.

Objective function: Find an optimal drill center location such that

Minimize: ΣCOST(i) for i=1 to N; and

Maximize: ΣREWARD(i) for i=1 to N where: N is the number of well trajectories.

COST(i) is total cost of the i-th well trajectory; and

REWARD (i) is total performance measurement of i-th well trajectory; subject to:

1) each well trajectory passes through the interior of the corresponding Dynamic Target Region;

2) each well trajectory satisfies user preference parameters within some specified tolerance; and 3) each well trajectory satisfies user-imposed anti-collision constraints.

The foregoing description is directed to particular embodiments of the present invention for the purpose of illustrating it. It will be apparent, however, to one skilled in the art, that many modifications and variations to the embodiments described herein are possible. All such modifications and variations are intended to be within the scope of the present invention, as defined in the appended claims.

The invention claimed is:

1. A method for determining drill center location and drill path for a well into a hydrocarbon formation, comprising:

selecting a target region of finite extent within the formation;

determining an initial target segment in the target region; and solving an optimization problem wherein a drill center location and a drill path are determined subject to a plurality of constraints, one of said constraints being that the drill path has to penetrate the target region, wherein the determining an initial target segment in the target region is performed before solving the optimization problem and constraining the solution of the optimization problem to require that the drill path include the initial target segment or, if adjusted later in the optimization, a then-current target segment.

2. The method of claim 1, wherein one or more additional constraints are selected from a group consisting of reservoir quality criteria including porosity; a minimum total measured depth; an accumulated dogleg angle maximum; one or more anti-collision distances; and a limiting area for drill center location.

3. The method of claim 1, further comprising selecting at least one additional target region of finite extent located either in said hydrocarbon formation or in another hydrocarbon formation, and constraining the optimization problem to require the drill path to also penetrate each additional target region.

4. The method of claim 1, further comprising selecting at least one additional target region of finite extent located either in said hydrocarbon formation or in another hydrocarbon formation, and allowing the optimization problem to consider at least one additional well and associated drill path from the drill center subject to a constraint that each additional target region must be penetrated by a drill path.

5. The method of claim 1, wherein the optimization problem uses a three-dimensional Earth model, and the target region's location is defined in the Earth model.

6. The method of claim 1, wherein the optimization problem comprises:

(a) using a well-path generation software program to generate a well path from an assumed initial drill center location and including the required target segment, then testing whether the drill path satisfies all the constraints;

(b) in response to a negative result from the test in (a), finding an alternative well path or adjusting the target segment, then testing again for whether the drill path satisfies the constraints; and (c) in response to a negative result from the test in (b), adjusting the drill center location, and repeating (a)-(c) using the adjusted drill center location.

7. The method of claim 6, further comprising in response to a test showing a current drill path and associated drill center location satisfy the constraints, devising a cost function to measure goodness of result, then computing the cost function for the current drill path and associated drill center location, and comparing the result to a selected criterion.

8. The method of claim 1, wherein the constraints are engineering or economic in nature.

9. The method of claim 1, wherein the optimization problem involves minimizing a cost function.

10. The method of claim 1, wherein the optimization problem first attempts to find an optimal drill path given an assumed drill center location, then if failing in that, adjusts the drill center location within a constrained surface area, and again attempts to find an optimal drill path, repeating until successful or until a sub-optimal drill path is found satisfying a specified criterion.

11. A method for producing hydrocarbons from a subsurface hydrocarbon formation, comprising:

(a) determining a drill path penetrating said hydrocarbon formation by:

selecting a target region of finite extent within the formation;

determining an initial target segment in the target region; and solving an optimization problem wherein a drill center location and a drill path are determined subject to a plurality of constraints, one of said constraints being that the drill path has to penetrate the target region, wherein the determining an initial target segment in the target region is performed before solving the optimization problem and constraining the solution of the optimization problem to require that the drill path include the initial target segment or, if adjusted later in the optimization, a then-current target segment; and (b) drilling a well following said drill path and producing hydrocarbons with the well.

* * * * *